US010752434B2

(12) United States Patent
Farrar et al.

(10) Patent No.: US 10,752,434 B2
(45) Date of Patent: Aug. 25, 2020

(54) TEMPERATURE CONTROLLED CARGO CONTAINERS

(71) Applicant: Sonoco Development, Inc., Hartsville, SC (US)

(72) Inventors: David Scott Farrar, Marietta, OH (US); Karen Rutter, Marietta, OH (US); Mark Rutter, Lowell, OH (US); Mark Hugh, Marietta, OH (US)

(73) Assignee: Sonoca Development, Inc., Hartsville, SC (US)

( * ) Notice: Subject to any disclaimer, the term of this patent is extended or adjusted under 35 U.S.C. 154(b) by 303 days.

(21) Appl. No.: 13/662,648

(22) Filed: Oct. 29, 2012

(65) Prior Publication Data

US 2013/0048647 A1 Feb. 28, 2013

Related U.S. Application Data

(63) Continuation-in-part of application No. 12/705,803, filed on Feb. 15, 2010, now abandoned.
(Continued)

(51) Int. Cl.
*B65D 88/74* (2006.01)
*F25D 11/00* (2006.01)
*F25D 11/02* (2006.01)

(52) U.S. Cl.
CPC ..... *B65D 88/745* (2013.01); *F25D 11/003* (2013.01); *F25D 11/006* (2013.01);
(Continued)

(58) Field of Classification Search
CPC .... F28D 20/026; F28D 20/028; F28D 20/021; F28D 20/02; F28D 2020/0008;
(Continued)

(56) References Cited

U.S. PATENT DOCUMENTS 211,821 A * 1/1879 Wickes ..... D06F 58/24 165/65
2,202,954 A * 6/1940 Lager ..... 62/425
(Continued)

FOREIGN PATENT DOCUMENTS

DE 1679202 A1 * 4/1971 ..... F24H 7/0416
EP 1128139 8/2001
(Continued)

OTHER PUBLICATIONS

PCT—International Search Authority, Notification of Transmittal of the International Search Report and the Written Opinion of the International Searching Authority of the Declaration, dated Nov. 29, 2010, in PCT/US10/49246.
(Continued)

*Primary Examiner* — Christopher R Zerphey
*Assistant Examiner* — For K Ling
(74) *Attorney, Agent, or Firm* — Miller, Matthias & Hull LLP

(57) ABSTRACT

Temperature controlled cargo containers may include thermal masses conditioned to temperatures above and/or below a target temperature. Example thermal masses may include plates including phase change materials, such as eutectic materials. One or more fans and flapper valves may be selectively operated to circulate air in the cargo container across one or more of the thermal masses to maintain the temperature within the cargo container within a prescribed temperature band. Some example temperature controlled cargo containers may include refrigeration units and/or heaters for regenerating the thermal masses when receiving power from an external power source and/or may include one or more rechargeable batteries for providing power during transport or storage independent of external power sources.

6 Claims, 15 Drawing Sheets

Related U.S. Application Data

(60) Provisional application No. 61/244,232, filed on Sep. 21, 2009.

(52) U.S. Cl.
CPC ..... *F25D 11/025* (2013.01); *F25B 2400/06* (2013.01); *F25D 2400/02* (2013.01)

(58) Field of Classification Search
CPC ..... F28D 2020/0013; F28D 2020/0026; F28D 2020/0047; F25D 3/06; F25D 2303/083; F25D 31/005; F25D 11/003; F25D 11/006; F25D 17/04; F25D 17/06; F25D 3/04; F25D 3/08; F25D 3/122; F25D 3/125; F25D 2303/082; F25D 2303/0821; F25D 23/063; F25D 23/066; F25D 23/06; F24H 7/0416; F24H 7/0425; F24H 7/0408; F24H 7/0458; F24F 5/0024; F24F 5/0017; F24F 2005/0025; F24F 2005/0032; F24F 2005/0028; F24F 5/0021; F24D 2220/10; F24D 11/006; F24D 11/008; F24D 11/009; F24D 11/0257; B65D 88/14
USPC ..... 165/10, 58, 201; 62/62, 65, 89, 90, 98, 62/99, 159, 371, 434, 437, 438, 425, 420, 62/421, 406, 312–314, 424
See application file for complete search history.

(56) References Cited

U.S. PATENT DOCUMENTS

| | | | | | |
|---|---|---|---|---|---|
| 2,249,202 | A | * | 7/1941 | Gienn | F25D 3/06 261/140.1 |
| 2,525,866 | A | * | 10/1950 | Christman | F25D 3/06 62/419 |
| 2,534,272 | A | * | 12/1950 | Kleist | 62/329 |
| 2,589,031 | A | * | 3/1952 | Allyne | 62/62 |
| 2,723,083 | A | | 11/1955 | Bary | |
| 2,739,521 | A | * | 3/1956 | Spear | 454/349 |
| 3,125,867 | A | | 3/1964 | Rath | |
| 3,180,403 | A | * | 4/1965 | Breen | 165/264 |
| 3,199,579 | A | * | 8/1965 | Foster et al. | 165/48.1 |
| 3,205,033 | A | * | 9/1965 | Stentz | 312/236 |
| 3,248,897 | A | * | 5/1966 | Stark | A41D 13/0053 62/259.3 |
| 3,468,369 | A | | 9/1969 | Reed | |
| 3,744,272 | A | * | 7/1973 | Oldberg | F24F 1/027 165/10 |
| 4,037,650 | A | * | 7/1977 | Randall | 165/10 |
| 4,104,185 | A | * | 8/1978 | Schroder | 252/70 |
| 4,234,782 | A | * | 11/1980 | Barabas et al. | 392/345 |
| 4,248,291 | A | * | 2/1981 | Jarmul | F28D 20/02 126/640 |
| 4,250,955 | A | * | 2/1981 | Plattner et al. | 165/244 |
| 4,259,401 | A | * | 3/1981 | Chahroudi et al. | 52/302.3 |
| 4,276,752 | A | * | 7/1981 | Modler et al. | 62/166 |
| 4,462,461 | A | * | 7/1984 | Grant | 165/202 |
| 4,502,293 | A | * | 3/1985 | Franklin, Jr. | F25D 3/125 62/388 |
| 4,528,439 | A | * | 7/1985 | Marney et al. | 219/386 |
| 4,709,750 | A | * | 12/1987 | White | 165/10 |
| 4,800,729 | A | * | 1/1989 | Hara | 62/185 |
| 4,831,837 | A | * | 5/1989 | Negishi et al. | 62/239 |
| 4,928,501 | A | * | 5/1990 | Negishi | 62/406 |
| 4,936,104 | A | * | 6/1990 | Hicke | 62/89 |
| 5,029,450 | A | * | 7/1991 | Takano et al. | 62/239 |
| 5,038,850 | A | * | 8/1991 | Choi | 165/10 |
| 5,159,973 | A | * | 11/1992 | Pennington et al. | 165/48.1 |
| 5,172,567 | A | * | 12/1992 | Sadhir | B29C 70/882 165/10 |
| 5,561,986 | A | * | 10/1996 | Goodall | 62/406 |
| 5,901,572 | A | * | 5/1999 | Peiffer et al. | 62/480 |
| 5,916,256 | A | * | 6/1999 | Westerholm | F25D 3/06 62/406 |
| 5,943,876 | A | * | 8/1999 | Meyer et al. | 62/371 |
| 5,950,450 | A | | 9/1999 | Meyer et al. | |
| 5,975,202 | A | | 11/1999 | Grandi | |
| 6,020,575 | A | | 2/2000 | Nagle et al. | |
| 6,116,042 | A | | 9/2000 | Purdum | |
| 6,192,703 | B1 | | 2/2001 | Salyer et al. | |
| 6,281,797 | B1 | * | 8/2001 | Forster et al. | 340/572.3 |
| 6,418,746 | B1 | * | 7/2002 | Dokoshi | 62/434 |
| D466,294 | S | | 12/2002 | Ekerot et al. | |
| D467,730 | S | | 12/2002 | Ekerot et al. | |
| 6,532,749 | B2 | * | 3/2003 | Rudick et al. | 62/6 |
| 6,668,819 | B1 | | 12/2003 | Remsburg | |
| 6,694,765 | B1 | * | 2/2004 | Waldschmidt et al. | 62/234 |
| 6,742,583 | B2 | * | 6/2004 | Tikka | H05K 7/206 165/261 |
| 6,860,082 | B1 | * | 3/2005 | Yamamoto | B62D 33/048 52/794.1 |
| 6,860,115 | B2 | * | 3/2005 | Norelius et al. | 62/387 |
| 6,865,516 | B1 | | 3/2005 | Richardson | |
| 7,263,855 | B2 | * | 9/2007 | Meyer et al. | 62/371 |
| 7,501,944 | B2 | * | 3/2009 | Hyde | 340/539.13 |
| 7,913,511 | B2 | | 3/2011 | Meyer et al. | |
| 8,162,542 | B2 | * | 4/2012 | Harman et al. | 374/208 |
| 8,826,687 | B2 | * | 9/2014 | Bellezza Quater et al. | 62/372 |
| 2004/0226309 | A1 | * | 11/2004 | Broussard | 62/236 |
| 2006/0042275 | A1 | * | 3/2006 | Tanaka | 62/126 |
| 2006/0060659 | A1 | * | 3/2006 | Dale | 236/44 C |
| 2006/0174648 | A1 | * | 8/2006 | Lantz | 62/371 |
| 2007/0175236 | A1 | | 8/2007 | Dryzun | |
| 2009/0139248 | A1 | | 6/2009 | Crumlin et al. | |
| 2012/0227424 | A1 | | 9/2012 | Beaver et al. | |
| 2014/0124158 | A1 | * | 5/2014 | Yamashita et al. | 165/10 |

FOREIGN PATENT DOCUMENTS

| | | | | | |
|---|---|---|---|---|---|
| FR | 2389222 | A1 | * | 11/1978 | H01H 9/104 |
| FR | 2691237 | | | 11/1993 | |
| FR | 2691237 | A1 | * | 11/1993 | F25D 16/00 |
| JP | 59027139 | A | * | 2/1984 | F24F 5/0017 |
| WO | WO 9610723 | A1 | * | 4/1996 | F25D 3/06 |
| WO | WO-9835193 | A1 | * | 8/1998 | F25D 16/00 |

OTHER PUBLICATIONS

Unknown, CPN Specialty Products: Cool Chain Logistics, www.cargopartnersnetwork.com/services-coolchain.html, Sep. 2, 2009.
De Silva, Dilshan, Cool Thinking Cuts Costs, Dispatch, Aug. 2007 Issue, Novo Nordisk, Australia.
Unknown, AcuTemnp-RKN, www.acutemp-rkn.com/rkn.html, Sep. 2, 2009.
Unknown, AcuTemp the Right Temperature, http://acutemp.com/temperatureSensitiveShipping/pharmaceutical.asp, Sep. 2, 2009.
Unknown, AcuTemp RKN Temperature Management Cargo Unit, cSafe LLC, © 2009, USA.

* cited by examiner

TEMPERATURE CONTROLLED CARGO CONTAINERS

CROSS REFERENCE TO RELATED APPLICATIONS

This application claims the benefit of U.S. patent application Ser. No. 12/705,803, filed Feb. 15, 2010, U.S. Provisional Application No. 61/244,232, filed Sep. 21, 2009, and PCT/US10/49246, filed Sep. 17, 2010, which are incorporated by reference.

BACKGROUND

The present disclosure is directed to containers for controlling the temperature of a product placed therein and methods of using temperature controlled cargo containers.

The following documents may be related to cargo containers and/or temperature controlled transport: U.S. Pat. Nos. 3,180,403; 4,462,461; 5,561,986; 6,020,575; 6,281,797; 6,694,765; 6,865,516; and 7,501,944; and U.S. Patent Application Publication No. 2007/0175236, and are incorporated by reference into this Background section.

SUMMARY

Some example temperature controlled cargo containers according to the present disclosure may include one or more thermal masses conditioned to temperatures above and/or below a target temperature. Example thermal masses may include plates including phase change materials, such as eutectic materials. One or more fans may be selectively operated to circulate air in the cargo container across one or more of the thermal masses to maintain the temperature within the cargo container within a prescribed temperature band. Some example temperature controlled cargo containers may include refrigeration units and/or heaters for regenerating the thermal masses while receiving power from an external power source and/or may include one or more rechargeable batteries for providing power during transport or storage independent of external power sources.

In an aspect, a method of controlling the temperature of a product may include placing a product in an interior storage space of a container, where the container includes a warm phase change plate and a cold phase change plate; and changing a temperature of the interior storage space by causing airflow across at least one of the warm phase change plate and the cold phase change plate.

In a detailed embodiment, changing the temperature of the interior storage space may include sensing a temperature associated with the product; if the temperature associated with the product is above a target temperature range, operating a cooling fan associated with causing air flow across the cold phase change plate; and if the temperature associated with the product is below the target temperature range, operating a warming fan associated with causing air flow across the warm phase change plate. In a detailed embodiment, operating the cooling fan associated with the cold phase change plate may include drawing air from the interior storage space through a separator wall at least partially interposing the interior storage space and the cold phase change plate, flowing the air through an open flapper valve past the cold phase change plate, and discharging the air into the interior storage space. In a detailed embodiment, operating the warming fan associated with the warm phase change plate may include drawing air from the interior storage space through a separator wall at least partially interposing the interior storage space and the warm phase change plate, flowing the air through an open flapper valve and past the warm phase change plate, and discharging the air into the interior storage space.

In a detailed embodiment, a method may include, prior to changing a temperature of the interior storage space, conditioning at least one of the warm phase change plate and the cold phase change plate. In a detailed embodiment, conditioning the cold phase change plate may include operating a refrigeration unit to cause freezing of a cold phase change solution within the cold phase change plate. In a detailed embodiment, conditioning the warm phase change plate may include operating a heater to melt a warm phase change solution within the warm phase change plate.

In a detailed embodiment, changing a temperature of the interior storage space may include directing the airflow along a first side of the at least one of the warm phase change plate and the cold phase change plate in a first direction and directing the airflow along a second side of the at least one of the warm phase change plate and the cold phase change plate in a second direction, where the second direction may be substantially opposite the first direction.

In a detailed embodiment, a method may include reducing natural circulation flow across at least one of the warm phase change plate and the cold phase change plate. In a detailed embodiment, reducing natural circulation flow across at least one of the warm phase change plate and the cold phase change plate may include providing flapper valves and an air trap associated with at least one of the warm phase change plate and the cold phase change plate. In a detailed embodiment, providing the air trap may include providing at least one of a downwardly extending wall at least partially interposing the warm phase change plate and the interior storage space, and an upwardly extending wall at least partially interposing the cold phase change plate and the interior storage space.

In a detailed embodiment, a method may include transporting the container from a first location to a second location while the product remains within the interior storage space.

In an aspect, a method of storing a product in a container may include operating a refrigeration system to cool a cold phase change plate associated with an interior storage space of a container; operating a heater to heat a warm phase change plate associated with the interior storage space; placing a product in the interior storage space; measuring a temperature associated with the interior storage space; and selectively operating at least one fan to cause airflow across at least one of the cold phase change plate and the warm phase change plate if the temperature associated with the interior storage space departs from a predetermined temperature range.

In a detailed embodiment, a method may include, prior to operating the refrigeration system and operating the heater, connecting the refrigeration system and the heater to a first external source of electrical power. In a detailed embodiment, a method may include, after operating the refrigeration system and operating the heater, disconnecting the refrigeration system and the heater from the first external source of electrical power. In a detailed embodiment, a method may include, after disconnecting the refrigeration system and the heater from the first external source of electrical power, loading the container into a vehicle. In a detailed embodiment, loading the container into a vehicle may include loading the refrigeration system and the heater into the vehicle, the refrigeration system and the heater being mounted to the container. In a detailed embodiment, a method may include transporting the container from a first location to a second location using the vehicle; and, at the second location, conditioning at least one of the cold phase change plate and the warm phase change plate. In a detailed embodiment, a method may include, prior to conditioning the at least one of the cold phase change plate and the warm phase change plate at the second location, connecting at least one of the refrigeration unit and the heater to a second external source of electrical power. In a detailed embodiment, a method may include, after the refrigeration unit and the heater have been disconnected from the first external source of electrical power and prior to connecting the refrigeration unit and the heater to the second external source of electrical power, operating the at least one fan using power supplied from a rechargeable battery associated with the container.

In an aspect, a temperature controlled container may include an interior space for receiving a product; a warm phase change plate arranged for selective heat exchange with the interior space; and a cold phase change plate arranged for selective heat exchange with the interior space.

In a detailed embodiment, the warm phase change plate and the cold phase change plate may be at least partially separated from the interior space by a separator wall. In a detailed embodiment, a temperature controlled cargo container may include a first fan selectively operable to cause forced convection between the interior space and the warm phase change plate; and a second fan selectively operable to cause forced convection between the interior space and the cold phase change plate. In a detailed embodiment, the cold phase change plate may include a first phase change solution, and the warm phase change plate may include a second phase change solution. In a detailed embodiment, a melting point of the second phase change solution may be higher than a melting point of the first phase change solution. In a detailed embodiment, a target temperature range may lie between the melting point of the first phase change solution and the melting point of the second phase change solution. In a detailed embodiment, the melting point of the first phase change solution may be about −5.5° C., and the melting point of the second phase change solution may be about 15° C. In a detailed embodiment, the target temperature range may be about 2-8° C.

In an aspect, a container may include an interior space for receiving a product; a phase change plate arranged for selective heat exchange with the interior space; and a trap arranged to reduce natural convection heat transfer between the phase change plate and the interior space while allowing forced convection heat transfer between the phase change plate and the interior space.

In a detailed embodiment, the phase change plate may include a cold phase change plate and/or the trap may include an upwardly extending wall at least partially interposing the interior space and the cold phase change plate. In a detailed embodiment, the trap may include a P-trap. In a detailed embodiment, a container may include a fan configured to cause air flow from the interior space, across the cold phase change plate, and into the interior space.

In a detailed embodiment, the phase change plate may include a warm phase change plate and/or the trap may include a downwardly extending wall at least partially interposing the interior space and the warm phase change plate. In a detailed embodiment, the trap may include a P-trap. In a detailed embodiment, a container includes a fan configured to cause air flow from the interior space, across the warm phase change plate, and into the interior space.

In an aspect, a container may include a phase change plate including a first side and a second side and/or a flow path arranged to direct airflow along the first side in a first direction and then along the second side in a second direction, where the second direction may be substantially opposite the first direction.

In a detailed embodiment, the first side may be substantially opposite the second side. In a detailed embodiment, a container may include at least one fan configured to cause the airflow through the flow path. In a detailed embodiment, the phase change plate may be at least partially separated from an interior storage space of the container by a wall.

In a detailed embodiment, the phase change plate may include at least one augmented surface. In a detailed embodiment, the augmented surface may include at least one internally extending fin.

In an aspect, a shipping system may include a container including an interior space for receiving a product, a warm phase change plate arranged for selective heat exchange with the interior space, and a cold phase change plate arranged for selective heat exchange with the interior space; a refrigeration system mounted to the container and configured to cool the cold phase change plate; and a heating system configured to heat the warm phase change plate.

In a detailed embodiment, a shipping system may include a data logger configured to record data pertaining to the container. In a detailed embodiment, the data may include a temperature associated with the interior space.

In a detailed embodiment, the warm phase change plate may include a cold phase change material having a melting point of about −5.5° C. In a detailed embodiment, the cold phase change plate may include a warm phase change material having a melting point of about 15° C. In a detailed embodiment, the heating system may include at least one electrical resistance heater in thermal communication with the warm phase change plate.

In an aspect, a container for shipping pharmaceuticals may include a warm phase change plate and/or a cold phase change plate.

In a detailed embodiment, the container may include an interior storage space for pharmaceuticals, the interior storage space being in selective thermal communication with the warm phase change plate and/or the cold phase change plate. In a detailed embodiment, a container may include a warming fan configured to cause airflow across the warm phase change plate and/or a cooling fan configured to cause airflow across the cold phase change plate. In a detailed embodiment, the cold phase change plate may include a cold eutectic material having a melting point of about −5.5° C. and/or the warm phase change plate may include a warm eutectic material having a melting point of about 15° C. In a detailed embodiment, a container a refrigeration system arranged to cool the cold phase change plate and/or a heater arranged to heat the warm phase change plate.

BRIEF DESCRIPTION OF THE DRAWINGS

The detailed description refers to the following figures in which.

DETAILED DESCRIPTION

Figure 1:
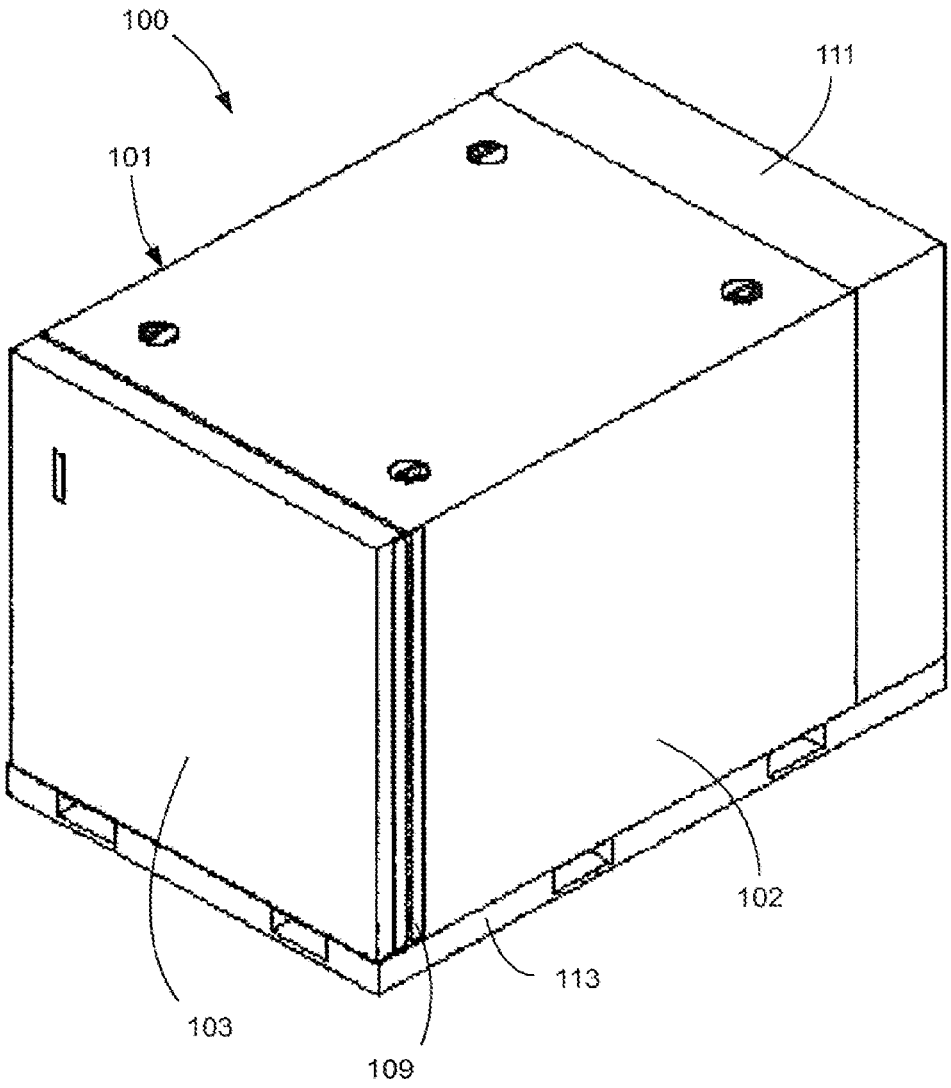
FIG. 1 is an isometric view of an example temperature controlled cargo container.
Figure 2:
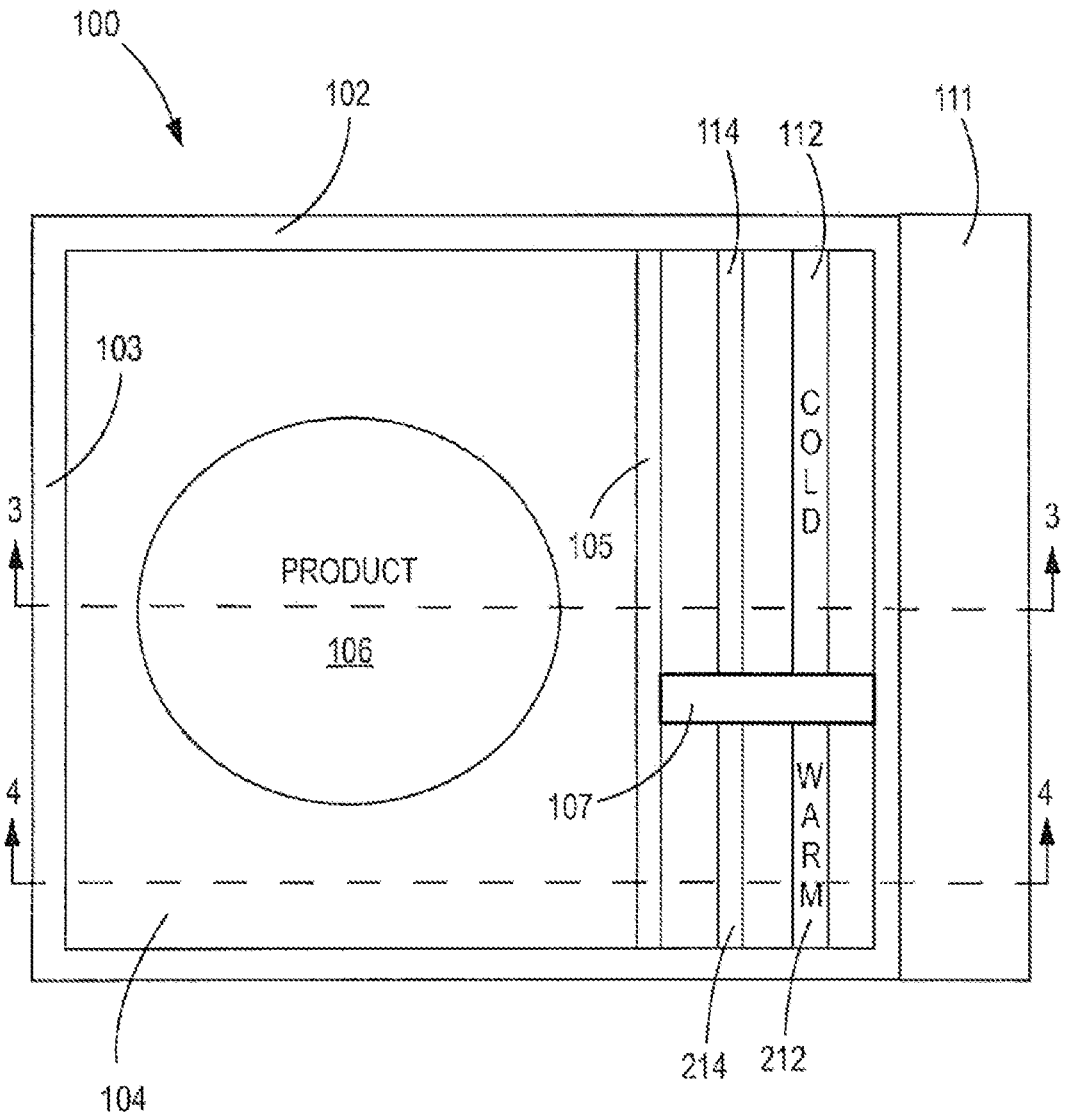
FIG. 2 is an overhead cross-sectional view of an example temperature controlled cargo container.
Figure 3:
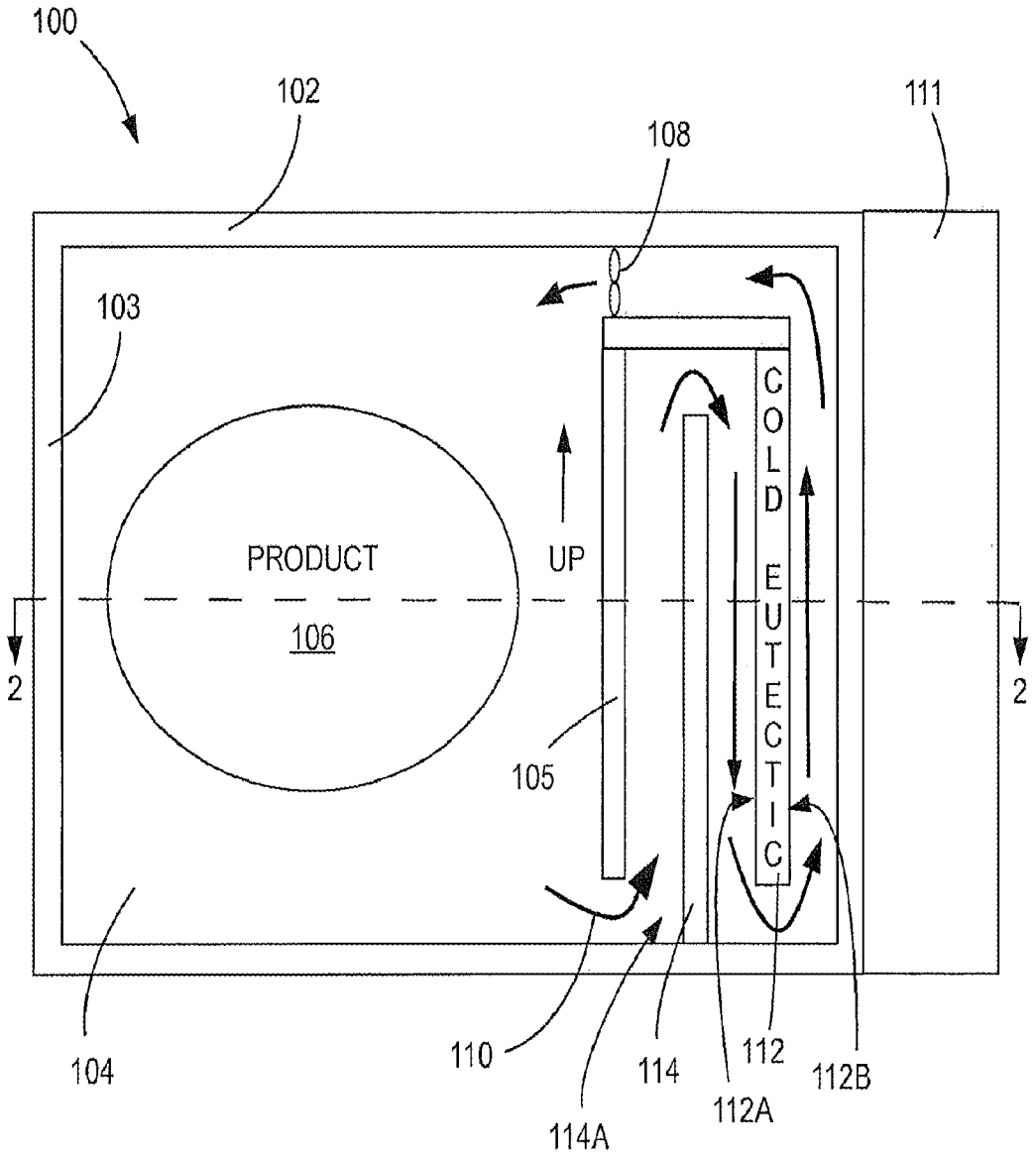
FIG. 3 is an elevational cross-sectional view of an example temperature controlled cargo container.

The present disclosure includes, inter alia, temperature controlled cargo containers and methods for using temperature controlled cargo containers.

The present disclosure contemplates that some products (e.g., pharmaceutical products) may be transported (e.g., by ground, sea, and/or air modes) and may be exposed to ambient conditions outside of an allowable product temperature range during such transportation and/or during storage. Temperature excursions outside of the allowable product temperature range may detrimentally affect a product, such as by reducing the efficacy and/or shelf life of a pharmaceutical product.

Some example temperature controlled cargo containers according to the present disclosure may be configured to maintain a product located therein within an allowable product temperature range while the temperature controlled cargo container is exposed to various ambient conditions. For example, some example temperature controlled cargo containers may be configured to maintain pharmaceutical products within an interior storage space at about 5° C. (e.g., between about 2° C. and about 8° C.) during ground, sea, and/or air transportation and/or during temporary and/or long-term storage. Some example temperature controlled cargo containers may maintain an interior storage space at about 5° C. for about 72 hours when the ambient temperature is about 30° C. while operating independently from external power sources and/or cooling sources. Some example temperature controlled cargo containers may maintain an interior storage space at about 5° C. during ambient temperature excursions, such as from about −40° C. to about +60° C.

Referring to FIGS. 1-8, an example temperature controlled cargo container 100 according to the present disclosure may include a generally rectangular enclosure 101 and/or an equipment section 111, which may be disposed substantially adjacent to enclosure 101. Enclosure 101 may include walls 102 and/or a door 103, which may be pivotably affixed to walls 102 by a hinge 109. In some example embodiments, door 103 and equipment section 111 may be disposed on generally opposite sides of enclosure 101. A door sealing assembly associated with door 103 may include thermal breaks on one or both sides of the door/enclosure interface, redundant compression bulb gaskets, and/or multipoint (e.g., three-point) draw latches which may fix the gasket compression depth. Enclosure 101 and/or equipment section 111 may be mounted on a pallet base 113, which may facilitate handling of temperature controlled cargo container 100 by forklifts and/or other material handling equipment, for example. An interior storage space 104 within enclosure 101 (which may be accessible via door 103) may receive a product 106, such as a pharmaceutical product.

Some example temperature controlled cargo containers 100 may include at least one cold thermal mass and/or at least one warm thermal mass disposed within enclosure 101. For example, a cold phase change plate 112 and/or a warm phase change plate 212 may be mounted within enclosure, such as generally opposite door 103. Cold phase change plate 112 may comprise a cold phase change material (PCM), which may include a eutectic material, having a desired melting point (e.g., about −5.5° C. (e.g., about 5.5° C. below 0° C.)). Warm phase change plate 212 may comprise a warm phase change material, which may include a eutectic material, having a desired melting point (e.g., about 15° C.).

Some example temperature controlled cargo containers may include one or more thermal masses (e.g., cold phase change plates 112 and/or warm phase change plates 212) having sufficient thermal capacitance (e.g., total energy capacity) to accommodate the total energy requirements of a design condition. Some exemplary temperature controlled cargo containers may include one or more thermal masses having sufficient surface area and/or thermal conductivity to accommodate the peak heat transfer rate requirements of a design condition.

Some example phase change plates may be constructed from, for example, galvanized steel, aluminum, and/or stainless steel. In some example embodiments, such materials may be welded. An example phase change plate may have a generally flattened, rectangular shape with dimensions of about 4.5"×6.5"×40". As used herein, "plate" refers to generally rectangular shapes as well as any other desirable shape.

Some example temperature controlled cargo containers 100 according to the present disclosure may be operated as follows. Warm phase change plate 212 and/or cold phase change plate 112 may be conditioned. As used herein, "conditioning" refers to freezing the cold phase change material of cold phase change plate 112 and/or melting the warm phase change material of warm phase change plate 212. Product 106 may be placed in interior storage space 104 of temperature controlled cargo container 100. The temperature of interior storage space 104 may be controlled by causing airflow across at least one of warm phase change plate 212 and cold phase change plate 112. Specifically, airflow across cold phase change plate 112 may cool interior storage space 104 and/or airflow across warm phase change plate 212 may warm interior storage space 104.

In some example temperature controlled cargo containers 100, one or more phase change plates 112, 212 may be mounted such that they are at least partially thermally insulated from one or more other phase change plates 112, 212 and/or from interior storage space 104. For example, a divider wall 107, which may be insulated, may interpose cold phase change plate 112 and warm phase change plate 212. An interior separator wall 105, which may be insulated, may at least partially interpose interior storage space 104 and cold phase change plate 112 and/or warm phase change plate 212. Thus, in some example embodiments, interior storage space 104 may be generally rectangular and/or may be substantially defined by door 103, walls 102, and/or interior separator wall 105. Interior separator wall 105 may not extend fully between walls 102, thereby allowing thermal communication between interior space 104 and phase change plates 112, 212 when desired.

In some example temperature controlled cargo containers 100, one or more cooling fans 108 may be selectively operable to cause flow of air 110 past a cold thermal mass, such as cold phase change plate 112, and/or one or more warming fans 208 may be selectively operable to cause flow of air 210 past a warm thermal mass, such as warm phase change plate 212. As illustrated in FIGS. 3-8, fans 108, 208 may be arranged draw air 110, 210 from interior storage space 104, through separator wall 105, and past phase change plate 112, 212 and/or to discharge air 110, 210 into interior storage space 104. Some example embodiments may include at least two cooling fans 108 and/or at least two warming fans 208, which may allow continued operation of temperature controlled cargo container 100 if one of cooling fans 108 and/or one of warming fans 208 fails. Some example cooling fans 108 and/or warming fans 208 may include fans driven by low voltage DC motors.

Some example temperature controlled cargo containers 100 may be configured to selectively direct air flow 110, 210 past one or more phase change plates 112, 212 such that the air 110, 210 passes along one side of phase change plate 112, 212 in a first direction and passes along an opposite side of phase change plate 112, 212 in an opposite direction. For example, referring to FIGS. 3-5, air 110 may flow generally downward along a front face 112A of cold phase change plate 112 and may flow generally upward along a rear face 112B of cold phase change plate 112. Similarly, referring to FIGS. 6-8, air 210 may flow generally upward along a front face 212A of warm phase change plate 212 and may flow generally downward along a rear face 212B of warm phase change plate 212. The present disclosure contemplates that such a flow arrangement may reduce the temperature variation in the phase change materials within cold phase change plate 112 and/or warm phase change plate 212 as measured along axes generally parallel with the air flow.

Some exemplary temperature controlled cargo containers may be designed to reduce natural convection (e.g., fluid motion caused by density differences in the fluid due to temperature gradients) past one or more phase change plates 112, 212. For example, referring to FIG. 3, an upwardly extending wall 114 (which may be referred to as a "false wall") may be provided near cold phase change plate 112, such as between cold phase change plate 112 and separator wall 105. Wall 114 may prevent cooler, denser air near the cold phase change plate 112 from settling into the interior storage space 104. Similarly, referring to FIG. 6, a downwardly extending wall 214 (which may be referred to as a "false wall") may be provided near warm phase change plate 212, such as between warm phase change plate 212 and separator wall 105. Wall 214 may prevent warmer, less dense air near the warm phase change plate 212 from rising into the interior storage space 104. Such walls 114, 214 may shape the respective air flow paths into P-traps 114A, 214A. Some example embodiments may direct air flow in a generally serpentine path past phase change plates 112, 212. In some example embodiments, walls 105, 114, 214 and/or phase change plates 112, 212 may provide a generally S-shaped serpentine air flow path.

Some exemplary embodiments may reduce natural convection using one or more devices in addition to or instead of a P-trap. For example, some example embodiments may include one or more dampers and/or shutters, which may be selectively opened and/or shut by pneumatic, spring, electromechanical (such as solenoid or motor) and/or other similar actuators. Such dampers and/or shutters may be mounted to obstruct a natural convection flow path, such as adjacent to separator wall 105.

Figure 4:
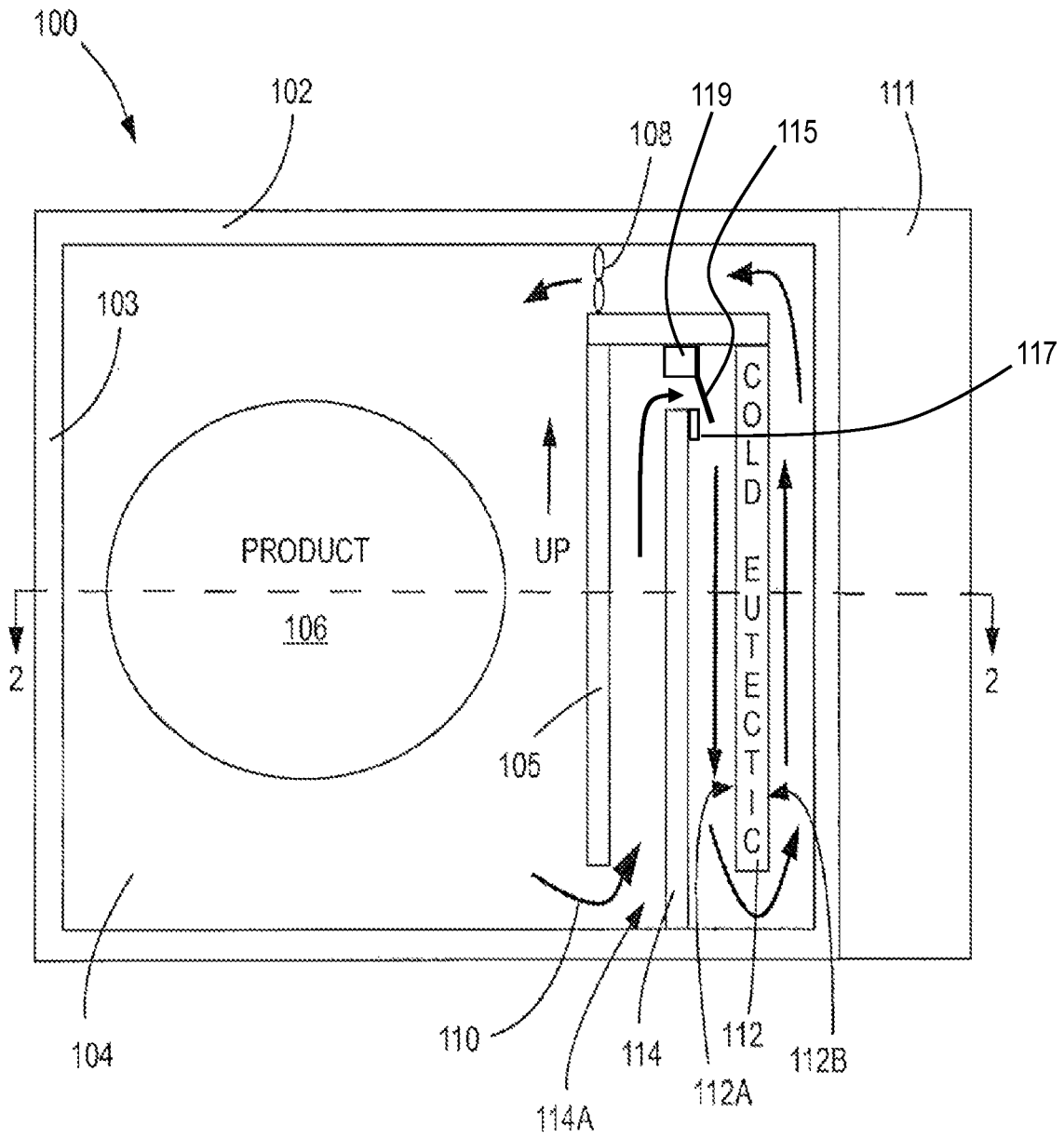
FIG. 4 is an elevational cross-sectional view of an example temperature controlled cargo container with open flapper valve.
Figure 5:
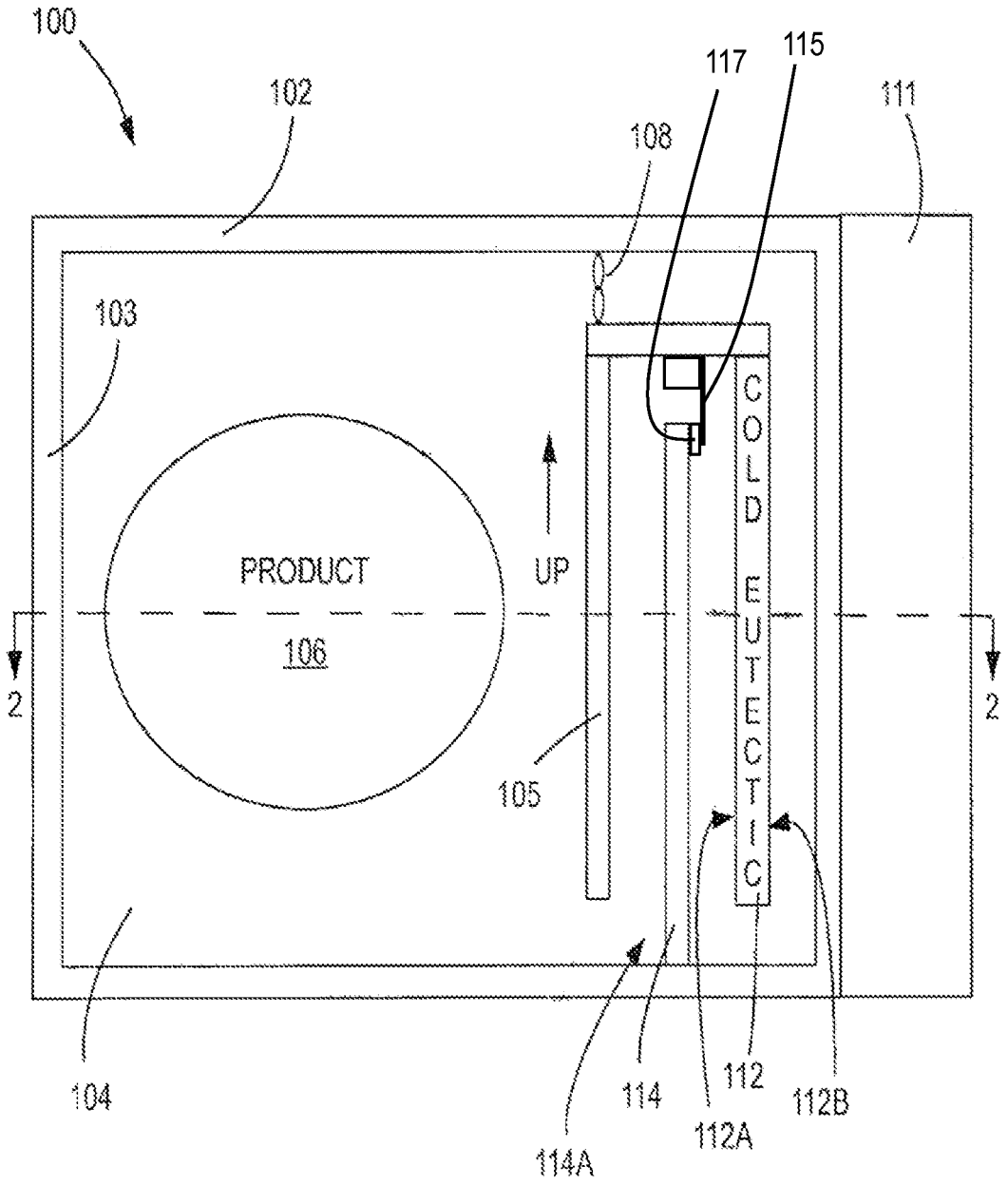
FIG. 5 is an elevational cross-sectional view of an example temperature controlled cargo container with closed flapper valve.
Figure 6:
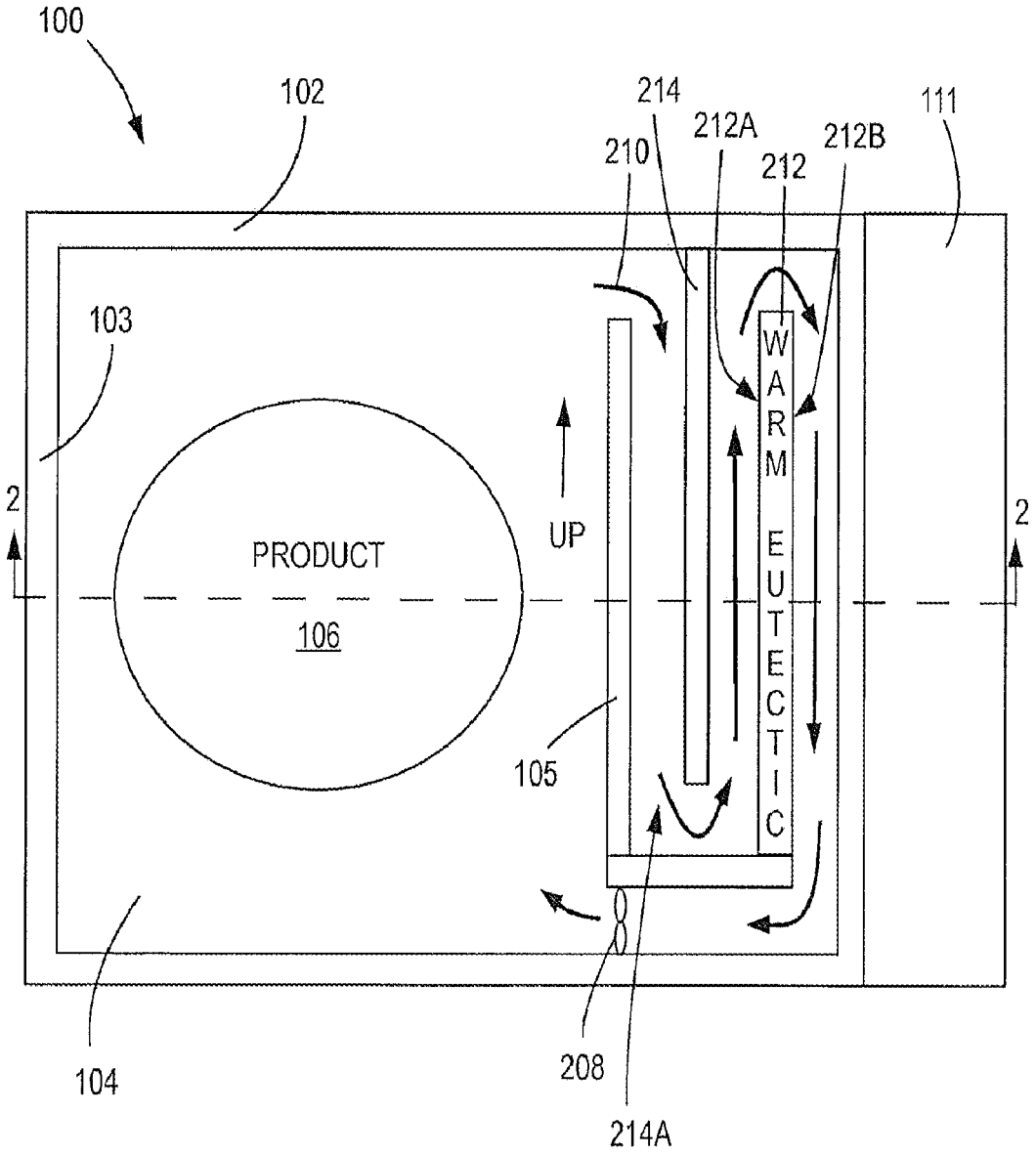
FIG. 6 is an elevational cross-sectional view of an example temperature controlled cargo container.

For example, as shown in FIGS. 4 and 5, natural convection may be significantly reduced when desired by providing a flapper valve 115 disposed in the airflow path. Flapper valve 115 may be hingedly attached to a flapper valve support 119 which may be installed near the cold phase change plate 112. In one embodiment, the flapper valve 115 and flapper valve support may be disposed substantially above the upwardly extending wall 114. The flapper valve 115 may also include a flapper valve backer 117 that may contact and may assist with the closing of valve 115 when desired. In one embodiment, as shown in FIGS. 5 and 6, flapper valve backer 117 may be disposed on the top end of upwardly extending wall 114 substantially aligned with and underneath flapper valve 115 and may be separated from the flapper valve by a portion of the airflow path. As shown in FIG. 4, when the cooling fan 108 is operating causing the air 110 to flow near the cold phase change plate 112 in a generally serpentine air flow path the air may flow with sufficient pressure to open the flapper valve 115 and pivot it away from flapper valve backer 117 so as to allow airflow to pass between the flapper valve 115 and the backer 115. As shown in FIG. 5, when the cooling fan 108 is off, the airflow caused by the fan substantially ceases allowing the flapper valve 115 to close and contact flapper valve backer 115. As shown in FIG. 5, when the flapper valve 115 is closed it may substantially block the air flow path 110. As such, when additional cooling in the interior storage space 104 is no longer required, and the cooling fan 108 is shut off, the flapper valve 115 closes against the backer 117 to obstruct convection from the cooling plate 112 into the interior storage space 104.

Figure 7:
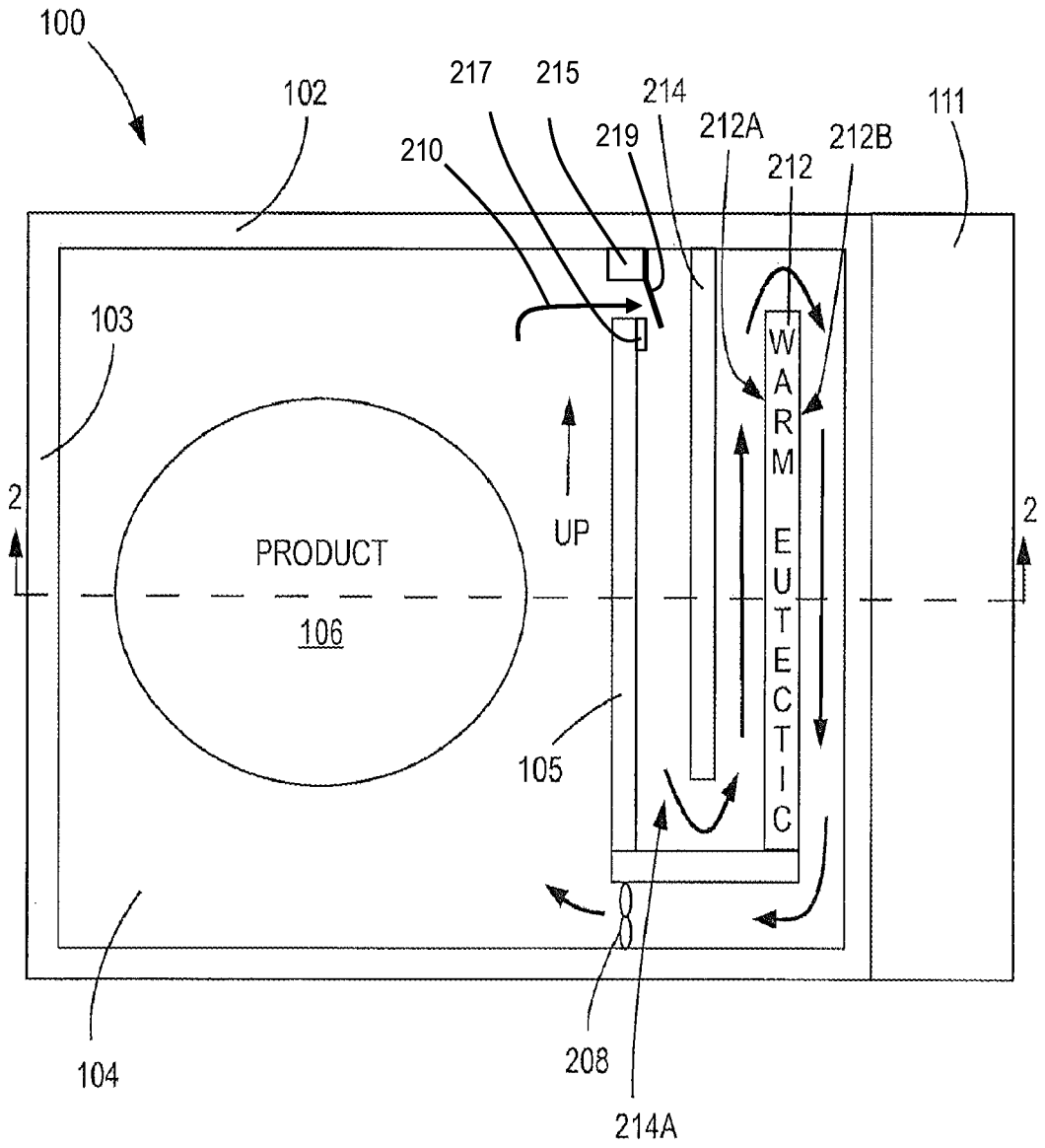
FIG. 7 is an elevational cross-sectional view of an example temperature controlled cargo container with open flapper valve.
Figure 8:
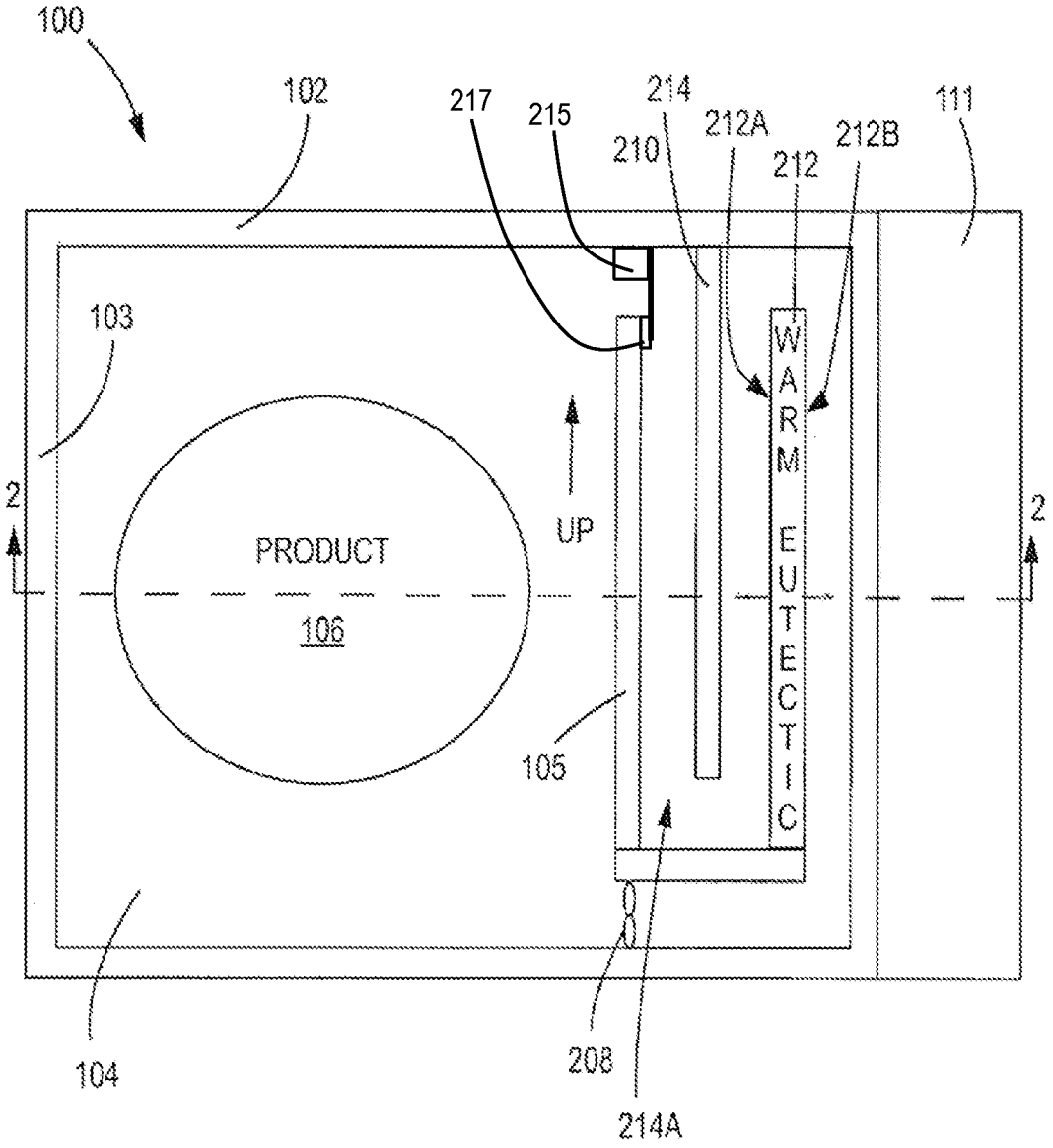
FIG. 8 is an elevational cross-sectional view of an example temperature controlled cargo container with closed flapper valve.

Similarly, as shown in FIGS. 6 and 7, natural convection may be significantly reduced when desired by providing a flapper valve 215 disposed in the airflow path near the warm phase change plate 212. Flapper valve 215 may be hingedly attached to a flapper valve support 219 which may be installed near the warm phase change plate 212. In one embodiment, the flapper valve 215 and flapper valve support may be disposed substantially above the interior separator wall 105. Just as with the flapper valve near the cold phase change plate 112, the flapper valve 215 may also include a flapper valve backer 217 that may contact and may assist with the closing of valve 215 when desired. In one embodiment, as shown in FIGS. 7 and 8, flapper valve backer 217 may be disposed on the top end of interior separator wall 105 substantially aligned with and underneath flapper valve 215 and may be separated from the flapper valve by a portion of the airflow path. As shown in FIG. 6, when the warming fan 208 is operating causing the air 210 to flow near the warm phase change plate 212 in a generally serpentine air flow path the air may flow with sufficient pressure to open the flapper valve 215 and pivot it away from flapper valve backer 217 so as to allow airflow to pass between the flapper valve 215 and the backer 215. As shown in FIG. 7, when the warming fan 208 is off, the airflow caused by the fan substantially ceases allowing the flapper valve 215 to close and contact flapper valve backer 215. As shown in FIG. 7, when the flapper valve 215 is closed it may substantially block the air flow path 210. As such, when additional warming in the interior storage space 104 is no longer required, and the warming fan 208 is shut off, the flapper valve 215 closes against the backer 217 to obstruct convection from the warming plate 212 into the interior storage space 104.

Any number of sufficiently resilient and flexible materials may be selected for the flapper valve 115, 215 including but not limited to a variety of plastics, rubber, silicon rubber, elastomers, or coated fabrics. To provide additional force to releasably close the flapper valve 115, 215 when the circulating fans 108, 208 stop operating and it is desired to close the flapper valves, the flapper valves 115, 215 may be at least partially comprised of ferrous material and the flapper valve backer 117, 217 may include a magnet that attracts and assists with drawing the flapper valves 115, 215 against the flapper valve backer 117, 217. It should be understood that the magnetic components of flapper valve 115, 215 and flapper valve backer 117, 217 could be reversed such that the flapper valve 115, 215 includes a magnet and the flapper valve backers 117, 217 include ferrous material that would cause the flapper valve 115, 215 with magnets to pull and attach to the backers 117, 217 when the circulating fan 108, 208 is stopped. It is contemplated that various known cooperative magnetic arrangements may be employed such as varying the magnetic strength of the backer 117, 217 or flapper valve 115, 215 at different points of an associated magnet to optimize the ability of the valve 115, 215 to stay open during circulating fan 108, 208 operation and to close when the fan operation is stopped.

Figure 9:
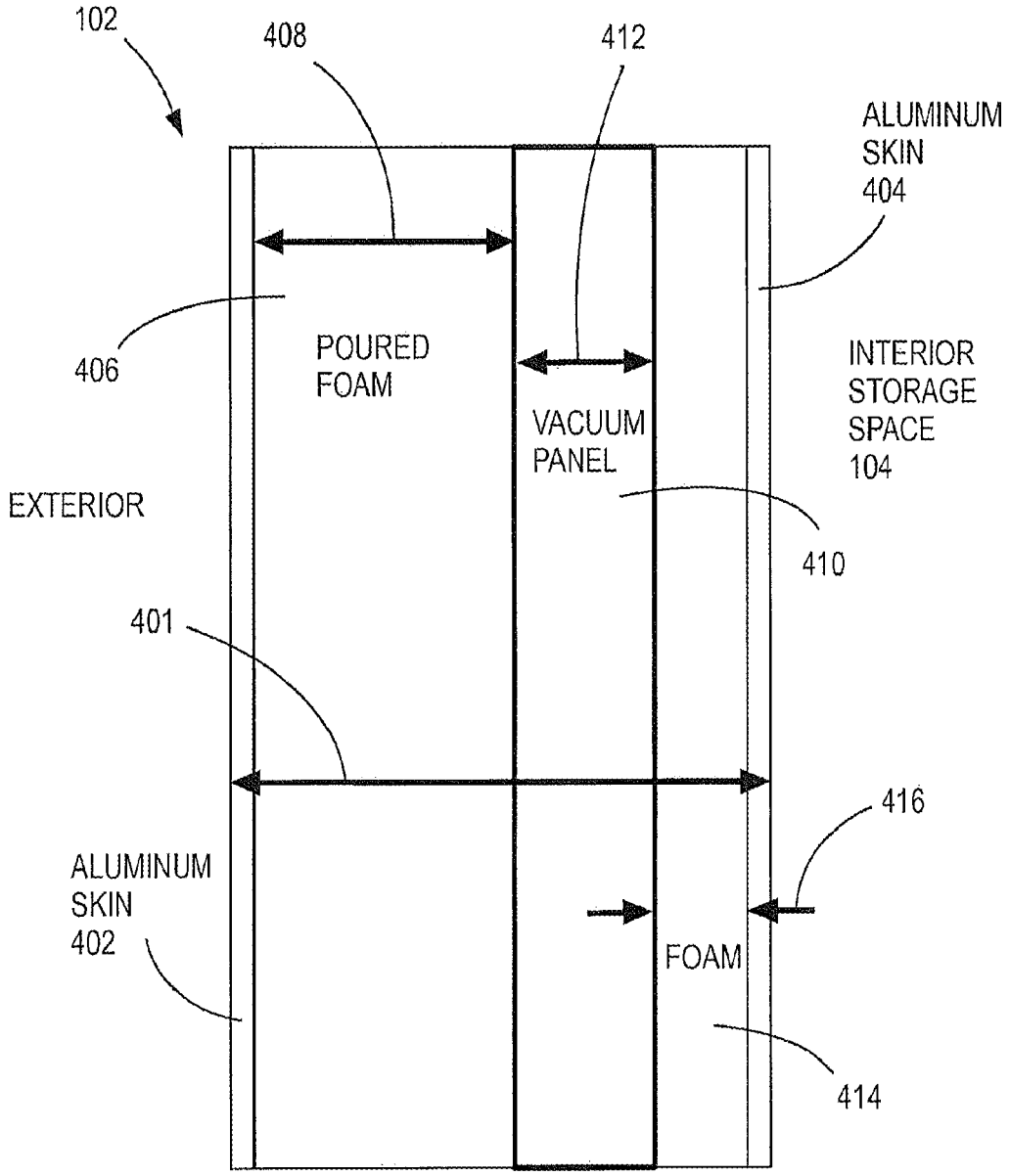
FIG. 9 is a cross-sectional view of a wall of an example temperature controlled cargo container.

Walls 102 may be insulated, such as by vacuum panels. In some example embodiments, walls 102 may have a thickness 401 of about 4" and/or may have an R-value (a measure of thermal resistance) of about R-70 to resist thermal energy transfer between interior storage space 104 and the ambient environment. Referring to FIG. 9, an example wall may include an exterior skin 402 and/or an interior skin 404. Exterior skin 402 and/or interior skin 404 may comprise aluminum and/or may have a thickness of about 0.030", for example. An insulating foam layer, such as poured foam 406, may be provided adjacent to exterior skin 402. Poured foam 406 may have a thickness 408 of about 2", for example. A vacuum panel 410 may be provided adjacent to poured foam 406. Vacuum panel 410 may have a thickness 412 of about 1", for example. An insulating foam layer, such as poured foam 414, may be provided between vacuum panel 410 and interior skin 404. Poured foam 414 may have a thickness 416 of about ½" or about ¾", for example. In some example embodiments, poured foam 414 may be replaced by a foam board, which may be bonded to vacuum panel 410 and/or interior skin 404, such as using an adhesive.

In some example temperature controlled cargo containers 100, walls 102 may comprise a stressed skin construction, which may provide a relatively high strength with relatively low weight. In some example embodiments, inner layers (e.g., poured foam 406, vacuum panel 410, and/or poured foam 414) and/or outer layers (e.g., exterior skin 402 and/or interior skin 404) may be disposed such that layers may not slide relative to others layer. Such a construction may provide a wall structure having relatively high area moment of inertia, which may add considerable structural strength to the product with minimal additional weight, while allowing a "flex" component to the structure.

Figure 10:
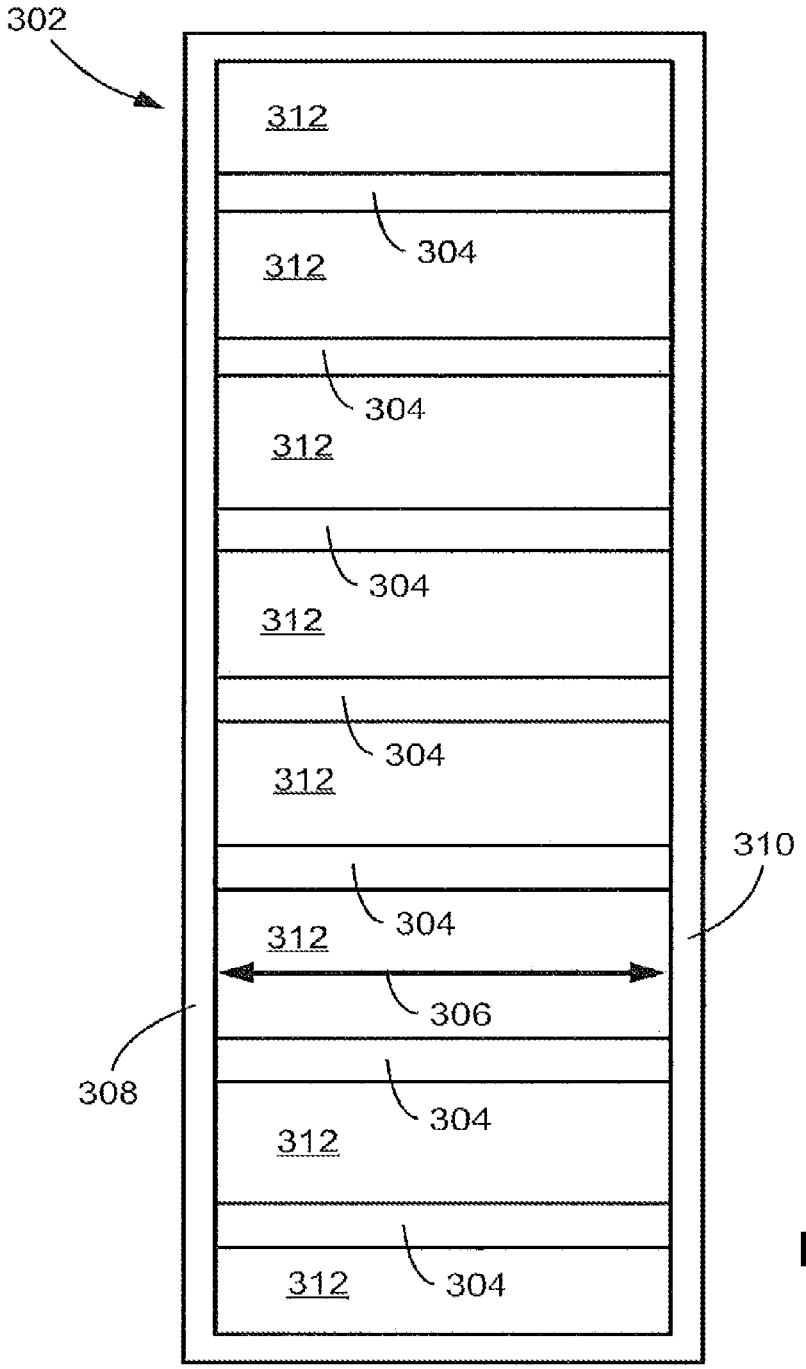
FIG. 10 is cross-sectional view of an example phase change plate for a temperature controlled cargo container.

Some exemplary temperature controlled cargo containers 100 may include one or more thermal masses including one or more augmented surfaces, such as fins and/or other similar heat transfer enhancing features, internally and/or externally. For example, referring to FIG. 10, an example phase change plate 302 may include one or more thermally conductive fins 304 extending through the thickness 306 of the plate 302, such as substantially from one wall 308 to the opposite wall 310, which may enhance heat transfer to and/or from phase change material 312 (e.g., a eutectic solution and/or other phase change material) between walls 308, 310. In some exemplary embodiments, one or more fins 304 may be mounted to the first wall 308 and may seat against the second wall 310 when the phase change plate 302 is assembled.

It is within the scope of the disclosure to utilize fins 304 or other conductive augmentations of any cross section or profile. The present disclosure contemplates that some example phase change materials may be relatively poor thermal conductors and that utilizing conductive augmentations within the phase change material may reduce the temperature gradient across the thickness of the phase change material. Some example phase change plates may include refrigerant lines (and/or lines for other materials used to condition phase change materials) and/or electrical resistance heaters extending therethrough for conditioning the phase change material.

Figure 11:
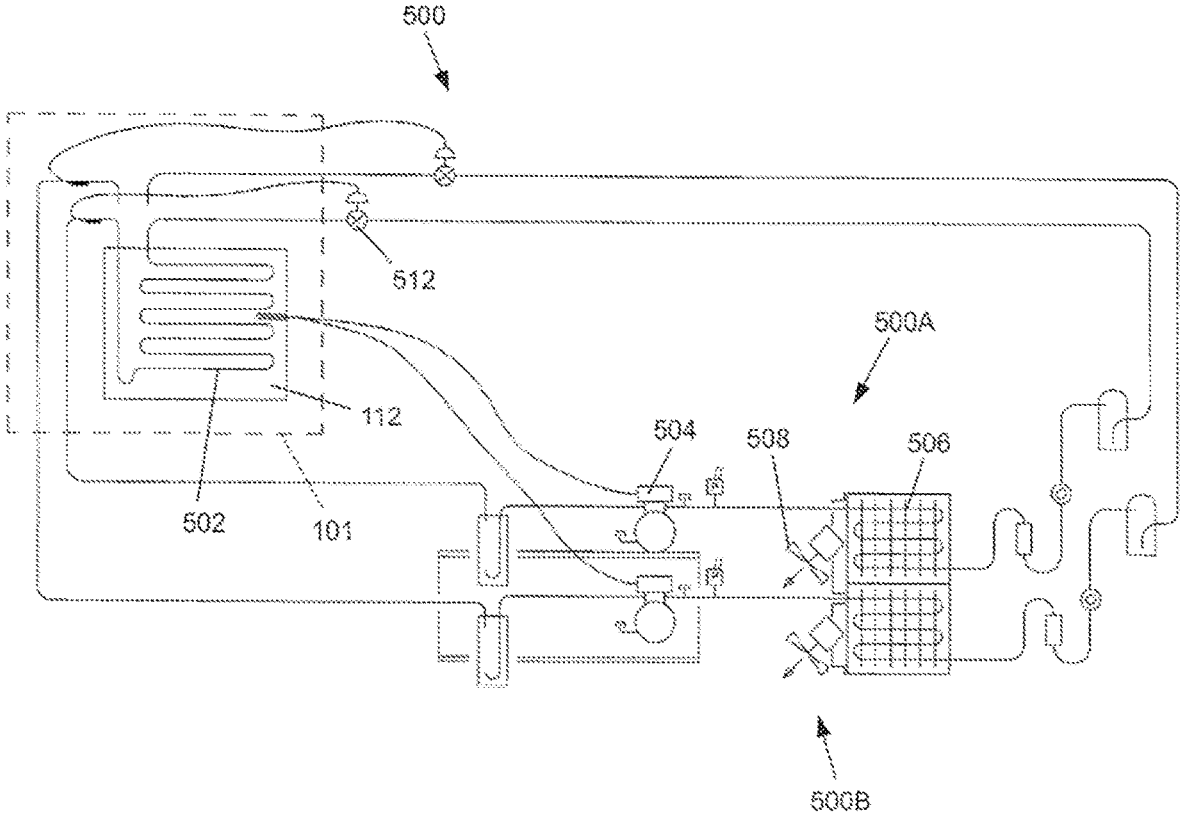
FIG. 11 is a schematic diagram of an example refrigeration system for a temperature controlled cargo container.

FIG. 11 is a schematic diagram of an example refrigeration system 500 which may be used in connection with an example temperature controlled cargo container 100. In some example embodiments, refrigeration system 500 may include two substantially independent refrigeration units 500A, 500B, thus providing redundancy. Refrigeration units 500A, 500B may be substantially identical and, for purposes, of clarity, FIG. 11 is discussed with reference to refrigeration unit 500A with the understanding that refrigeration unit 500B may include corresponding components. An individual refrigeration unit 500A may include a compressor 504, a condenser 506, a fan 508 configured to provide airflow across condenser 506, and/or an expansion valve 512.

In some example embodiments, an individual refrigeration unit 500A may include an evaporator 502 disposed in thermal communication with one or more cold phase change plates 112 (e.g., with evaporator coils extending through the interior of cold phase change plate 112). In some example embodiments, evaporators 502 associated with more than one individual refrigeration unit 500A, 500B may be in thermal contact with the same cold phase change plate 112, which may increase the reliability of temperature controlled cargo container 100 because the failure of a single refrigeration unit 500A, 500B may not prevent cold phase change plate 112 from being conditioned. Each of refrigeration units 500A, 500B may be sized to be capable of conditioning one or more cold phase change plates 112 without the other system operating. However, the time to condition one or more cold phase change plates 112 with a single refrigeration unit 500A, 500B operating may be longer than the time to condition one or more cold phase change plate 112 with both refrigeration units 500A, 500B operating. In some example embodiments, one or more cold phase change plates 112 and/or evaporator 502 may be located within enclosure 101 and/or many of the remaining components of refrigeration units 500A, 500B may be disposed in equipment section 111.

Figure 12:
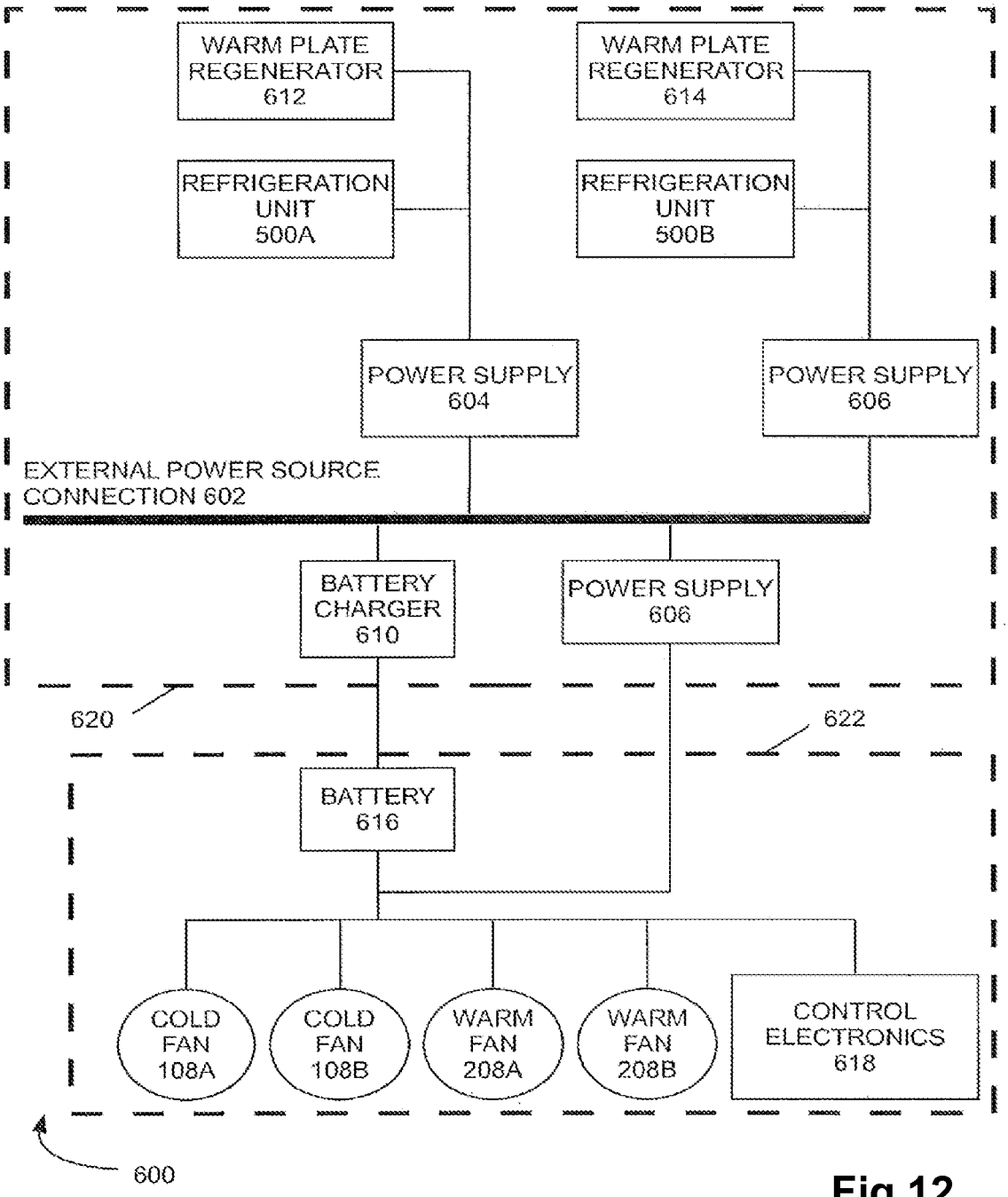
FIG. 12 is a schematic diagram of an example electrical system for a temperature controlled cargo container.

FIG. 12 is a schematic diagram of an example electrical system 600 associated with a temperature controlled cargo container 100 according to the present disclosure. An external power source connection 602 may provide power to one or more power supplies 604, 606, 608 and/or a battery charger 610. Power supply 604 may feed refrigeration unit 500A and/or warm plate regenerator 612 (e.g., an electrical resistance heater in thermal contact with warm phase change plate 212). Power supply 606 may feed refrigeration unit 500B and/or warm plate regenerator 614. Battery charger 610 may provide a charging current to rechargeable battery 616, which may feed control electronics 618, warming fans 208A, 208B, and/or cooling fans 108A, 108B. Power supply 608 may also feed control electronics 618, warming fans 208A, 208B, and/or cooling fans 108A, 108B.

Some example temperature controlled cargo containers 100 may be operable in a recharge mode (also referred to as an active mode) and/or a transport move (also referred to as a passive mode). In an example recharge mode, a temperature controlled cargo container 100 may connected to an external power source, such as standard electric line power (e.g., 100-230 VAC, 50 or 60 Hz).

In the recharge mode, refrigeration units 500A, 500B may cool cold phase change plate 112, which may freeze the cold phase change material of cold phase change plate 112. Similarly, one or more warm plate regenerators 612, 614 (e.g., electrical resistance heaters) may heat warm phase change plate 212, which may melt the warm phase change material of warm phase change plate 212. Refrigeration units 500A, 500B and/or regenerators 612, 614 may be powered from the external power source. Rechargeable battery 616 (such as a 12 V lead-acid battery) may be charged from the external power source. In some example embodiments, the components within box 620 as well as the components within box 622 of FIG. 12 may be powered from the external power source when in the recharge mode.

Figure 13:
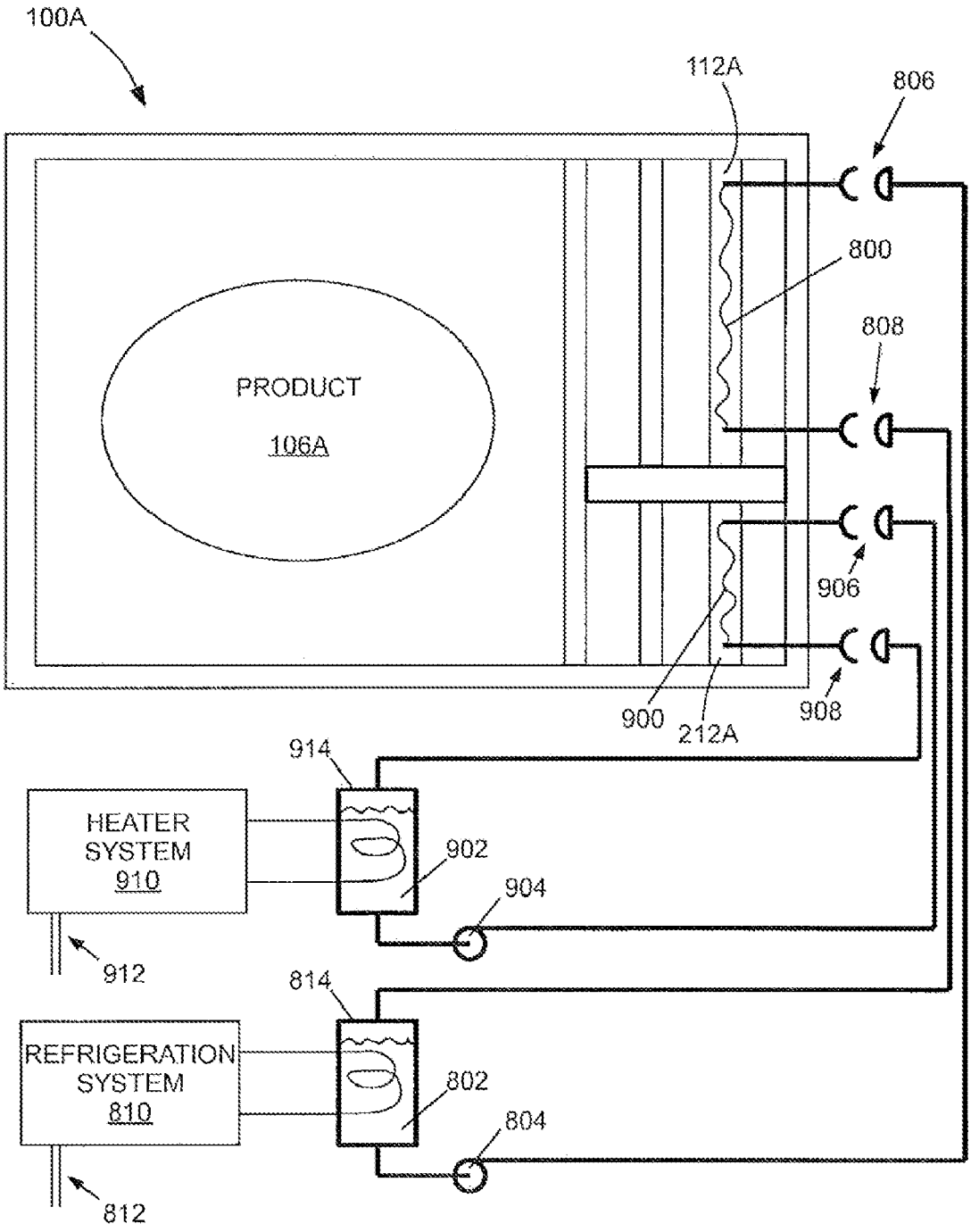
FIG. 13 is a schematic diagram illustrating an example temperature controlled cargo container configured for use with external conditioning sources.

Referring to FIG. 13, some example temperature controlled cargo containers according to the present disclosure may be constructed to interface with external conditioning systems. Such embodiments may or may not include refrigeration units 500A, 500B, warm plate regenerators 612, 614, and/or equipment section 111. As illustrated in FIG. 13, an example temperature controlled cargo container 100A holding product 106A may be generally similar to temperature controlled cargo container 100 described above. Temperature controlled cargo container 100A may be configured for use with externally supplied conditioning for cold phase change plate 112A and/or warm phase change plate 212A. For example, cold phase change plate 112A may be conditioned by a chilled fluid 802 (e.g., a water-ethylene glycol solution at about −5° C.) circulated through a heat exchanger 800 in thermal contact with cold phase change plate 112A. Chilled fluid 802 may be propelled by a pump 804 via through appropriate conduits, which may include fittings 806, 808 (e.g., quick disconnect fittings). A refrigeration system 810, which may be powered from an external power source 812, may remove heat from chilled fluid 802 using a heat exchanger 814. In some example embodiments, refrigeration system 810 may include one or more vapor-compression refrigeration systems, which may be generally similar to refrigeration units 500A, 500B.

Similarly, warm phase change plate 212A may be conditioned by a warmed fluid 902 (e.g., a water-ethylene glycol solution at about 25° C.) circulated through a heat exchanger 900 in thermal contact with warm phase change plate 212A. Warmed fluid 902 may be propelled by a pump 904 via through appropriate conduits, which may include fittings 906, 908 (e.g., quick disconnect fittings). A heater system 910, which may be powered from an external power source 912, may remove heat from chilled fluid 902 using a heat exchanger 914. In some example embodiments, heater system 910 may include one or more electrical resistance heaters in thermal contact with warmed fluid 902 in heat exchanger 914.

Figure 14:
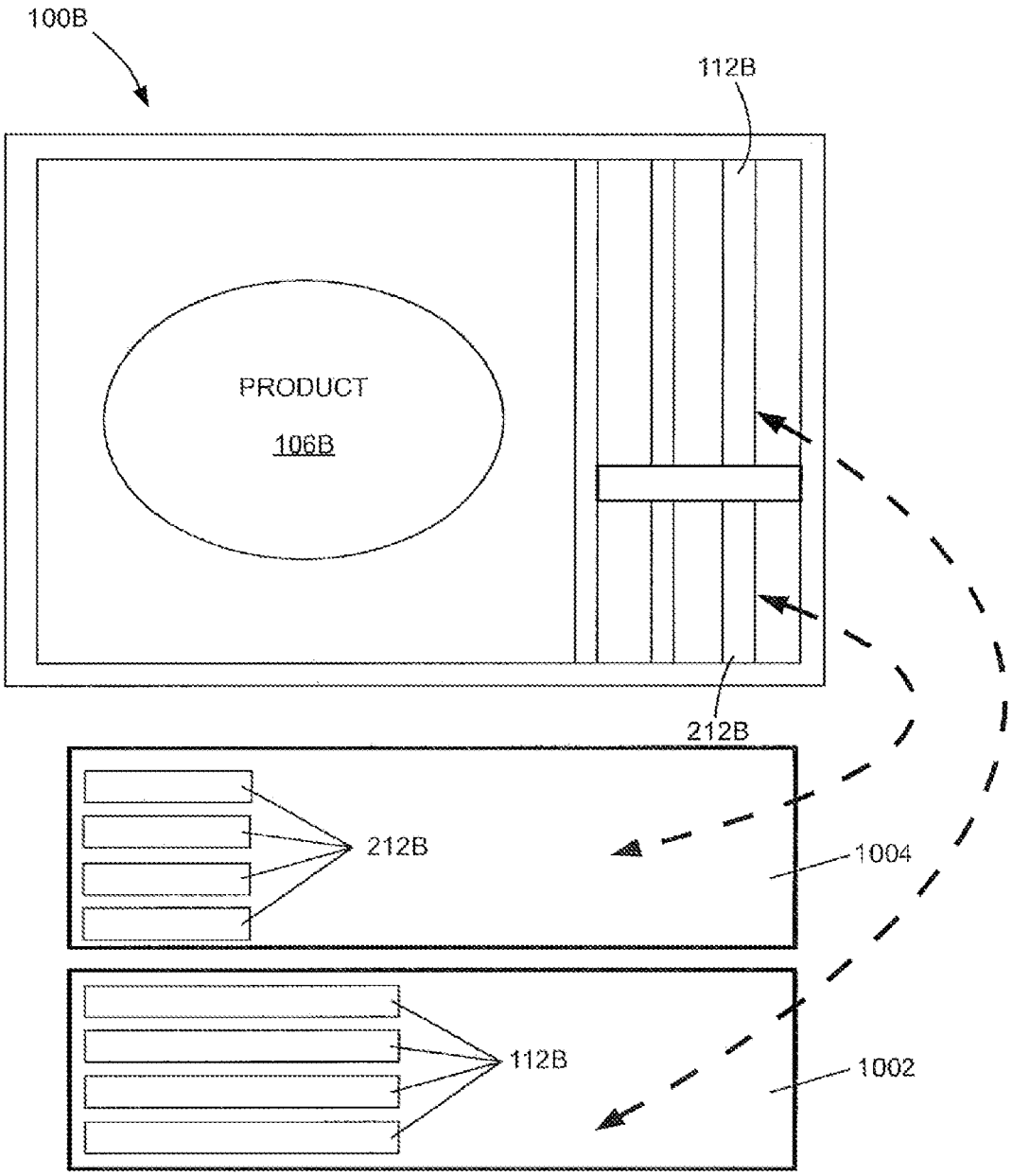
FIG. 14 is a is a schematic diagram illustrating an example temperature controlled cargo container configured for use with removable phase change plates.

Referring to FIG. 14, Some example temperature controlled cargo containers 100B according to the present disclosure may include one or more readily removable and/or replaceable cold phase change plates 112B and/or warm phase change plates 212B. Such example embodiments may allow pre-conditioned cold phase change plates 112B and/or warm phase change plates 212B to be installed into temperature controlled cargo container 100B prior to transport. In addition, such embodiments may permit replacement of partially or fully expended cold phase change plates 112B and/or warm phase change plates 212B with conditioned cold phase change plates 112B and/or warm phase change plates 212B during extended storage and/or during extended transport. Such embodiments may or may not include refrigeration units 500A, 500B, warm plate regenerators 612, 614, and/or equipment section 111. For example, removable cold phase change plates 112B may be conditioned in an environmental chamber 1002 (which may be maintained at about −5° C.) and/or removable warm phase change plates 212B may be conditioned in an environmental chamber 1004 (which may be maintained at about 15° C.).

In an example transport mode, some example temperature controlled cargo containers 100 may be disconnected from the external power source and/or conditioning source. In the transport mode, the temperature of interior storage space 104 may be monitored, and one or more of fans 108A, 108B, 208A, 208B may be selectively operated to circulate air across one or more cold phase change plates 112 and/or one or more warm phase change plates 212 as necessary to maintain the temperature of interior storage space 104 within a prescribed temperature band (e.g., between about 2° C. and about 8° C.). For example, if the temperature within the interior storage space 104 exceeds a predetermined setpoint, fans 108A, 108B may be operated to circulate air across cold phase change plate 112, which may cool interior storage space 104. Similarly, if the temperature within interior storage space 104 drops below a predetermined setpoint, fans 208A, 208B may be operated to circulate air across warm phase change plate 212, which may warm interior storage space 104.

More specifically, circulation of air across cold phase change plate 112 may transfer heat from the air to the cold phase change material, which may cause the cold phase change material to melt. As the cold phase change material melts, it may absorb from the air an amount of heat equal to its latent heat of fusion. Similarly, circulation of air across warm phase change plate 212 may transfer heat from the warm phase change material to the air, which may cause the warm phase change material to freeze. As the warm phase change material freezes, it may transfer to the air an amount of heat equal to it latent heat of fusion.

Control electronics 618 (e.g., temperature monitoring components, fan control components, etc.) and/or fans 108A, 108B, 208A, 208B may be powered from the rechargeable battery 616 in the transport mode. In some example embodiments, refrigeration units 500A, 500B used to cool cold phase change plates 112 and/or the regenerator used to heat warm phase change plates 212 may not operate during transport mode. In some example embodiments, the components within box 622 of FIG. 12 may be powered from battery 616 during the transport mode.

In some example embodiments, various control electronics 618 (which may include a status panel) may be powered from rechargeable battery 616 during the transport mode. The control electronics may include, for example, a low power embedded industrial PC for low power consumption and/or low EMI (electromagnetic interference). The control electronics and/or status panel may be configured to communicate the condition of the cargo unit to the user. For example, a temperature of the interior storage space 104 may be displayed and/or transmitted to a user. In some example embodiments, a data logger may monitor and/or record the temperature in the interior storage space 104. In some example embodiments, the data logger may be independently powered by a non-replaceable battery with an extended life, such as a three year life.

Figure 15:
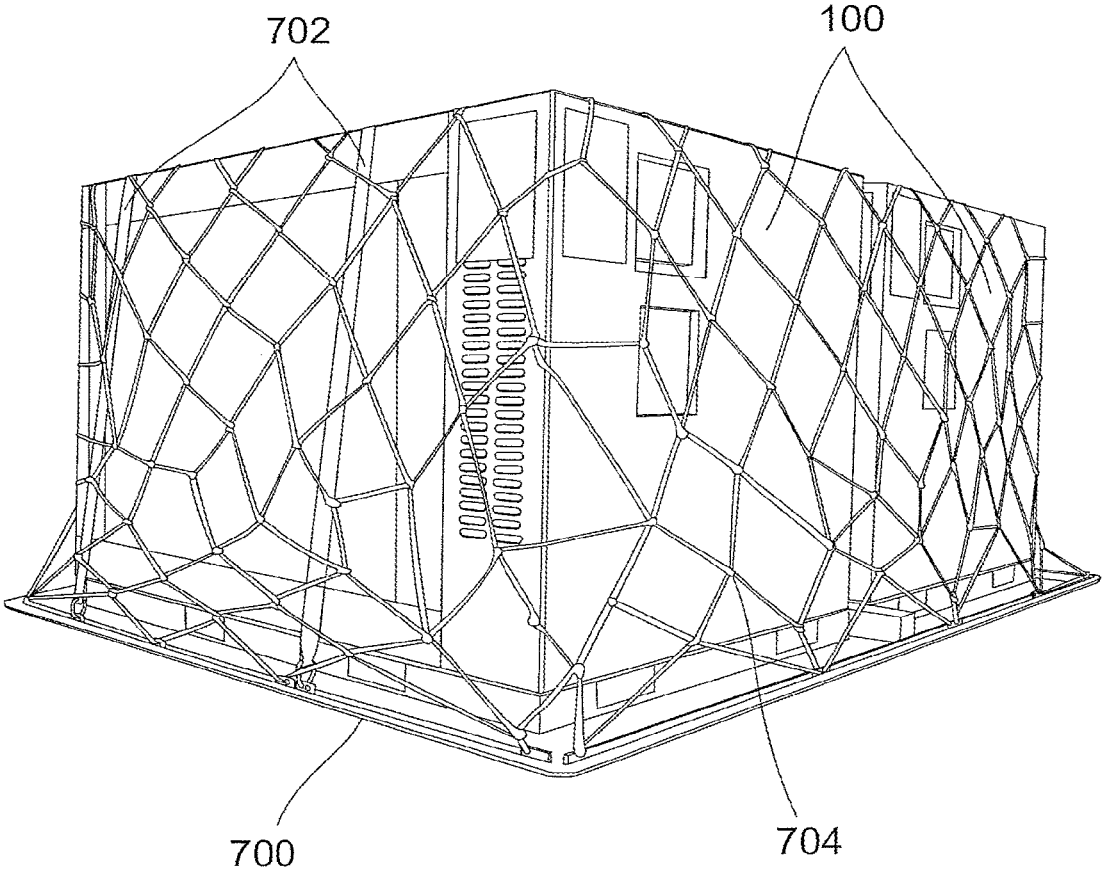
FIG. 15 is a perspective view of two example temperature controlled cargo containers on an aircraft pallet; all arranged in accordance with at least some aspects of the present disclosure.

Some exemplary temperature controlled cargo containers according to the present disclosure may be configured to be received within and/or on an air transport cargo unit for shipment via air. For example, two exemplary 76 cubic foot capacity temperature controlled cargo containers 100 may be placed inside an L9 unit load device (ULD) for shipment aboard certain types of aircraft. Similarly, as illustrated in FIG. 15, some example temperature controlled cargo containers 100 may be transported in a net/pallet configuration. One or more temperature controlled cargo containers 100 may be placed on a generally flat pallet 700, which may be referred to as a "cookie sheet" in the air transport industry. Temperature controlled cargo containers 100 may be fastened to pallet 700 using, for example, one or more straps 702 and/or nets 704. Pallet 700 with temperature controlled cargo containers 100 thereon may be considered a ULD for air transport purposes and/or may be readily loaded into and secured within an aircraft (or other vehicle).

Some example temperature controlled cargo containers 100 according to the present disclosure may be configured to function as a ULD in an air transport system. Such example embodiments may be sized and/or shaped substantially the same as a ULD used by an air carrier, and the air carrier may load such temperature controlled cargo containers 100 in an aircraft in generally the same manner as other ULDs.

Some example temperature controlled cargo containers 100 may be sized to receive standard units of product. For example, an example 76 cubic foot capacity temperature controlled cargo container 100 may include an interior storage space 104 sized to receive an about 40"×48" pallet containing about 250 lbs. of product. In such an example embodiment, interior storage space 104 may have interior dimensions of about 46" high×44" wide×53" deep. Such an example embodiment may have overall dimensions of about 58" high×52.75" wide×80" long, and its tare weight may be about 1250 lbs.

Some example thermal masses comprising phase change materials may include one or more of water, potassium nitrate, ethylene glycol, propylene glycol, one or more alcohols (e.g., ethyl alcohol, methyl alcohol, and/or isopropyl alcohol), potassium chloride, sodium borate, zinc, and/or ammonium chloride. In general, it is within the scope of the present disclosure to utilize one or more thermal masses comprising any materials capable of accepting and/or delivering appropriate amounts of thermal energy at appropriate rates to satisfy design conditions. Further, it is within the scope of the present disclosure to utilize any phase change materials providing desired melting points.

Some example temperature controlled cargo containers have been described herein with reference to a target temperature of about 5° C., which may correspond to temperature range of about 2° C. to about 8° C. Other example temperature controlled cargo containers according to the present disclosure may be configured to maintain a product located therein at colder temperatures (e.g., about −20° C., about −40° C., about −80° C., and/or about −100° C.) or warmer temperatures (e.g., about 25° C., about 50° C., and/or about 60° C.). In general, temperature controlled cargo containers according to the present disclosure may be configured to maintain any desired interior temperature.

Some example temperature controlled cargo containers according to the present disclosure may include warm and cold thermal masses including phase change materials having melting points differing from a target temperature by various amounts. For example, a warm phase change material may have a melting point about 15° C. above a target temperature and a cold phase change material may have a melting point about 15° C. below the target temperature. Similarly, the melting points of the warm and cold phase change materials may differ from the target temperature by any other desired amount (e.g., about 5° C., about 10° C., about 20° C., about 25° C., etc.). In some example embodiments, the melting point of the warm phase change material may differ from the target temperature by a greater (or lesser) amount than the cold phase change material differs from the target temperature. For example, a warm phase change material may have a melting point of about 10° C. about above a target temperature and a cold phase change material may have a melting point of about 20° C. below the target temperature.

Some example temperature controlled cargo containers may be operated as follows. A refrigeration system may be operated to cool a cold phase change plate associated with an interior storage space of a container. A heater may be operated to heat a warm phase change plate associated with the interior storage space. A product may be placed in the interior storage space. A temperature associated with the interior storage space may be measured. At least one fan may be selectively operated to cause airflow across at least one of the cold phase change plate and the warm phase change plate if the temperature associated with the interior storage space departs from a predetermined temperature range.

As used herein, ambient conditions refer to the environmental conditions to which a temperature controlled cargo container is subject. For example, the ambient temperature for a temperature controlled cargo container on an airport ramp may be the outside air temperature at the ramp. As another example, the ambient temperature for a temperature controlled cargo container being transported in an aircraft at cruise altitude may be the interior temperature of the aircraft where the temperature controlled cargo container is stowed.

While exemplary embodiments have been set forth above for the purpose of disclosure, modifications of the disclosed embodiments as well as other embodiments thereof may occur to those skilled in the art. Accordingly, it is to be understood that the disclosure is not limited to the above precise embodiments and that changes may be made without departing from the scope. Likewise, it is to be understood that it is not necessary to meet any or all of the stated advantages or objects disclosed herein to fall within the scope of the disclosure, since inherent and/or unforeseen advantages may exist even though they may not have been explicitly discussed herein.

What is claimed is:

1. A temperature controlled cargo container for shipping a product at or near a target temperature, the cargo container comprising:

an interior storage space for receiving the product;

a warm phase change plate arranged for selective heat exchange with the interior storage space, the warm phase change plate having a generally flattened rectangular shape including a flat exterior front face and a flat exterior rear face, the warm phase change plate containing a warm phase change material;

a cold phase change plate arranged for selective heat exchange with the interior storage space, the cold phase change plate having a generally flattened rectangular shape including a flat exterior front face and a flat exterior rear face, the cold phase change plate containing a cold phase change material located between the front face and the rear face;

an insulated divider wall interposing the cold phase change plate and the warm phase change plate, the warm phase change plate being mounted such that it is at least partially thermally insulated from the cold phase change plate;

at least one coil extending within the cold phase change plate and in direct contact with the cold phase change material, wherein a chilled fluid is adapted to circulate through the coil to thereby cool the cold phase change material of the cold phase change plate;

wherein the warm phase change plate and the cold phase change plate are at least partially separated from the interior storage space by a separator wall, the separator wall defining a plurality of openings;

a downwardly extending wall located between the separator wall and the warm phase change plate;

an upwardly extending wall located between the separator wall and the cold phase change plate;

a first fan selectively operable to draw air from within the interior storage space, through a first opening in the separator wall, then along a first serpentine flow path comprising a first direction between the separator wall and the downwardly extending wall, a second direction opposite the first direction between the downwardly extending wall and the flat exterior front face of the warm phase change plate, and a third direction opposite the second direction, then through a second opening in the separator wall and into the interior storage space; and a second fan selectively operable to draw air from within the interior storage space, through a third opening in the separator wall, then along a second serpentine flow path comprising a first direction between the separator wall and the upwardly extending wall, a second direction opposite the first direction between the upwardly extending wall and the flat exterior front face of the cold phase change plate, and a third direction opposite the second direction, then through a fourth opening in the separator wall and into the interior storage space.

2. The temperature controlled cargo container of claim 1 further comprising at least one trap arranged to reduce natural convection heat transfer between at least one of said warm phase change plate and said cold change phase plate and the interior storage space.

3. The temperature controlled cargo container of claim 1 further including at least one valve operable to permit airflow about at least one of said warm phase change plate and said cold phase change plate wherein said at least one valve comprises a flapper valve including a flapper valve backer, wherein flapper valve and said flapper valve backer further comprises a magnet, and wherein said flapper valve and said flapper valve backer further comprises ferrous material, wherein when one of said first and second fans is operating sufficient airflow is generated to overcome an associated magnetic force between said flapper valve and said flapper valve backer such that said flapper valve is open and airflow is permitted therethrough, and wherein when one of said first and second fans is shut off the associated magnetic force between said flapper valve and said flapper valve backer causes said flapper valve to close and obstruct airflow between said interior storage space and at least one of said warm phase change plate and said cold phase change plate.

4. The temperature controlled cargo container of claim 1 including an electrical resistance heater in thermal contact with the warm phase change plate.

5. The temperature controlled cargo container of claim 1 further comprising:

a heat exchanger in thermal contact with the warm phase change plate wherein warmed fluid may be propelled through conduits and quick disconnect fittings and into the warm phase change plate and in direct contact with the warm phase change material.

6. The temperature controlled cargo container of claim 1 wherein the warm phase change plate comprises a front wall and an opposing rear wall and one or more thermally conductive fins extending through the warm phase change plate from the front wall to the opposing rear wall.

* * * * *